United States Patent [19]

Conlon

[11] 4,015,940

[45] Apr. 5, 1977

[54] HOLDING DEVICE FOR LABORATORY WARE

[76] Inventor: Daniel R. Conlon, 600 Meetinghouse Road, Jenkintown, Pa. 19046

[22] Filed: Apr. 28, 1976

[21] Appl. No.: 680,990

[52] U.S. Cl. ..... 23/259; 23/292; 211/60 R; 211/71; 211/74; 248/310; 248/311.1

[51] Int. Cl.[2] ..... B01L 9/00; B01L 3/00

[58] Field of Search ..... 23/292, 259; 211/248, 211/60 R, 71, 74; 248/310, 311.1, 146, 153

[56] References Cited

UNITED STATES PATENTS

| | | | |
|---|---|---|---|
| 637,996 | 11/1899 | Powel | 248/310 X |
| 1,149,010 | 8/1915 | Wilson | 248/153 X |
| 1,315,087 | 9/1919 | Caire | 431/289 |
| 2,215,411 | 9/1940 | Sebring | 248/311.1 |
| 2,415,012 | 1/1947 | James | 46/1 R |
| 2,991,039 | 7/1961 | Aimes | 248/311.1 |
| 3,028,702 | 4/1962 | St. Cyr | 248/310 X |
| 3,918,920 | 11/1975 | Barber | 211/74 X |
| 3,969,080 | 7/1976 | Cenlon | 23/259 |

*Primary Examiner*—Barry S. Richman

[57] ABSTRACT

A supporting device for laboratory containers, bottles, and the like which comprises a helical spring joined at its ends to form a torus-shaped body with several turns of said spring being loosely affixed to a base, thereby permitting expansion of said torus-shaped body when an object having a dimension greater than the central opening of the torus is inserted therein. Preferably said helical spring is wound to have substantially no compression and tension between turns, a natural frequency between 10 and 100 cycles per minute, and the spring wire is of a thin, rectangular cross-section with the long side directed radially.

2 Claims, 5 Drawing Figures

Fig. 3
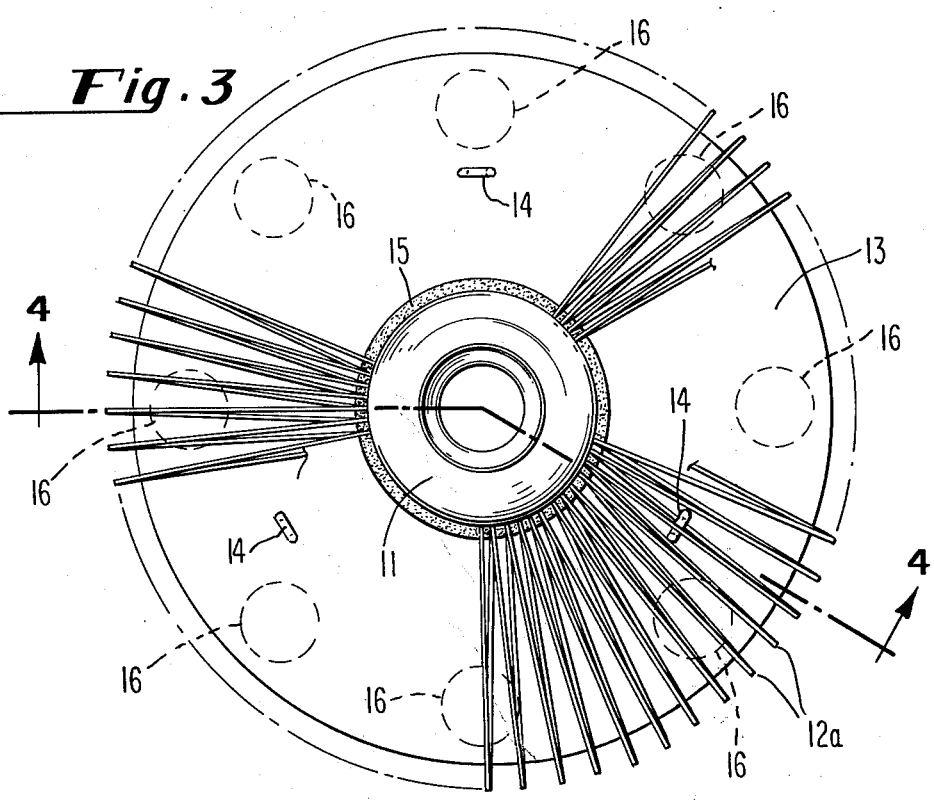
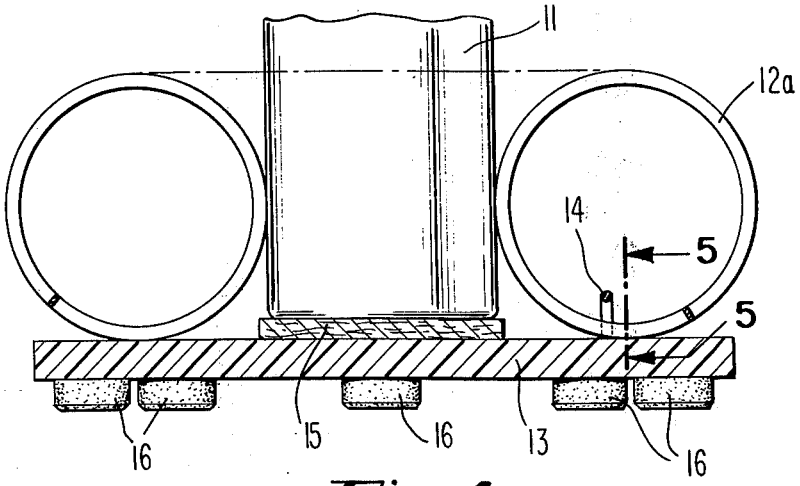
Fig. 4
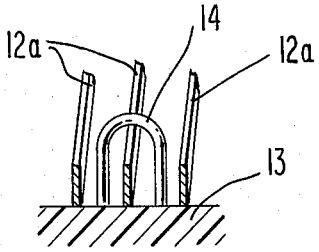
Fig. 5

HOLDING DEVICE FOR LABORATORY WARE

This invention pertains to a supporting device for bottles, containers, and the like, particularly for small containers such as bottles, inkwells, small laboratory flasks and the like which are easily knocked over and their contents spilled. A particular object of the invention is to provide a small support which is adaptable to various sized containers without any special adjustment being made.

It is known in the art (U.S. Pat. No. 1,315,087) to hold candles with a device wherein a plurality of resilient tongues are encircled by a coil spring to press the tongues against the candle. Such a device is limited to supporting only a candle or a similar object of a given diameter and does not permit its use for holding various sized objects.

in accord with the present invention, a novel supporting device meeting the objects of the invention is obtained by novel application of a helical spring, preferably one such as described in U.S. Pat. No. 2,415,012 (R. T. James). To fabricate the supporting device of the invention, the helical spring is joined at its ends to form a torus and the torus loosely supported through several of equally spaced apart turns of the spring to a base whereby any object of a size greater than that of the central hole of the torus and which when placed therein will cause the torus to expand and each turn of the spring will exert a small force on the object and hold it in position.

A further understanding of the invention will be obtained from a study of the drawings.

FIG. 3 is a plan view of the device holding a bottle.

FIG. 4 is a side view taken along 4—4 of FIG. 3.

FIG. 5 is a detailed view along 5—5 of FIG. 4 showing how the spring torus is fixed to a base.

Figure 1:
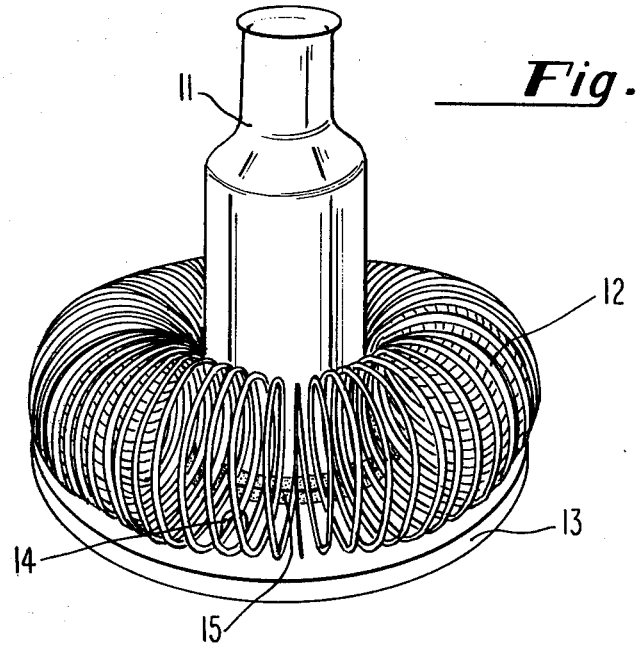
FIG. 1 is a perspective view of the device holding a small bottle.

Referring now to FIG. 1, the drawing illustrates how the device holds a small bottle in a stabilized position. The bottle 11 sits within the torus-shaped body shown generally as 12 and made from a helical spring. This helical spring may be made from ordinary spring wire. In the preferred spring embodiment, the turns rest in lateral contact without the necessity of any external compression other than the weight of the turns, and the coils can be extended slightly without overcoming any appreciable internal force due to spring action. Also the spring will preferably have a low natural frequency, suitably between 10 and 100 cycles per minute. The spring also will preferably have a rectangular cross-section with its long side directly radially. These spring properties are described in the James patent referred to above. The torus is affixed to a base 13 by fastening means through several turns of the spring, preferably equally spaced apart. Such fastening means is shown as a staple 14 in the detail of FIG. 5. The diameter of the base as shown may be essentially that of the torus-shaped spring, but is preferably slightly larger. The base will preferably be of a moderately heavy material (preferably a dense plastic) so as to hold the device down when removing the article being held by the spring. A disc-like pad 15, made of cork or other resilient material may be optionally affixed to the base 13 by an adhesive or other means to cushion any shock to fragile vessels placed within the torus. If desired, the pad 15 may be made of or covered with asbestos to provide a heat-resistant surface. In joining the ends of the spring to form a torus, the ends may be joined by clips, glued together, or otherwise fixed in position to form the torus shape.

Figure 2:
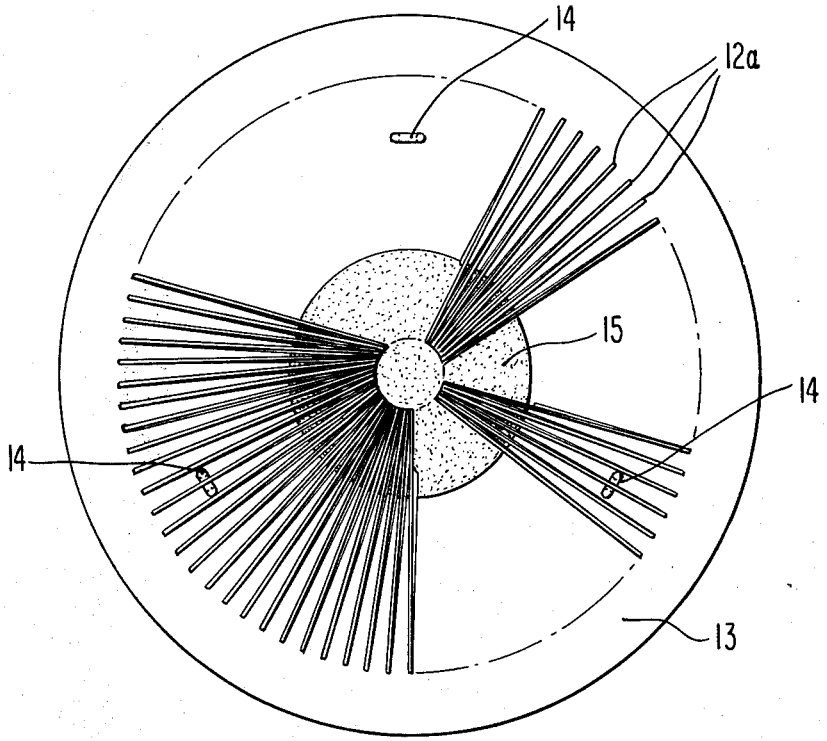
FIG. 2 is a plan view of the empty supporting device.

FIG. 2 is a plan view of the device devoid of any vessel. The helical spring torus is shown only partially, the numerous equally spaced apart turns or splines of the spring 12*a* making up the torus. In this FIG. 2, the optional cushioning pad 15 resting on base 13 and fastening staples 14 are clearly seen.

FIG. 3 is a plan view similar to FIG. 2 except that the bottle 11 shown in perspective in FIG. 1 is being held within the torus. As the bottle or other vessel pushes against the turns (e.g. the splines) of the spring, the inside diameter of the torus is enlarged and each tine pushes against the bottle with an equal force, thus stabilizing the vessel in the position in which it is placed within the torus. These inwardly directed force vectors are equally distributed and symmetrical if the vessel is symmetrical and, in any event, reflect the shape of the vessel inserted in the torus. FIG 3 also shows a number of foot pads 16 on the underside of the base 13 which may optionally be used.

FIG. 4 which is taken along line 4—4 of FIG. 3, shows in more detail how the splines 12*a* press against the bottle 11 to hold it upright.

FIG. 5, which is taken along line 5—5 of FIG. 4 shows in more detail how a fastening device such as a staple 14 fixes the torus to the base 13. As can be seen also in FIG. 5, the spring wires forming the splines 12*a* are of a rectangular cross-section which is the preferred embodiment.

I claim:

1. A supporting device for laboratory flasks and containers, bottles and the like which are relatively unstable on a flat surface which comprises a helical spring joined at its ends to form a torus-shaped body with several turns of said spring being loosely affixed to a base, thereby permitting expansion of said torus-shaped body when an object having a dimension greater than the central opening of the torus is inserted therein, wherein said helical spring is constructed of a thin wire having a rectangular cross-section with its long side directed radially relative to the helix and is wound to have no compression or tension between turns, and wherein the natural frequency of said spring is between 10 and 100 cycles per minute.

2. In combination, a laboratory container which is relatively unstable on a flat surface and a supporting device for said laboratory container surrounding and in contact with said container and holding it in a fixed position, said supporting device comprising a helical spring joined at its ends to form a torus-shaped body with several turns of said spring being loosely affixed to a base, said helical spring being constructed of a thin wire having a rectangular cross-section with its long side directed radially relative to the helix and being wound to have no compression or tension between turns, said helical spring having a natural frequency of between 10 and 100 cycles per minute, said container having a dimension, at its location of contact with said torus-shaped body, greater than the unexpanded central opening of said torus-shaped body.

* * * * *